US008758528B2

(12) United States Patent
Shimamura et al.

(10) Patent No.: US 8,758,528 B2
(45) Date of Patent: Jun. 24, 2014

(54) HIGH-STRENGTH STEEL PLATE, METHOD OF PRODUCING THE SAME, AND HIGH-STRENGTH STEEL PIPE

(75) Inventors: Junji Shimamura, Hiroshima (JP); Shigeru Endo, Hiroshima (JP); Mitsuhiro Okatsu, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 43 days.

(21) Appl. No.: 11/887,018

(22) PCT Filed: Mar. 30, 2006

(86) PCT No.: PCT/JP2006/307285

§ 371 (c)(1),
(2), (4) Date: Oct. 5, 2007

(87) PCT Pub. No.: WO2006/104261

PCT Pub. Date: Oct. 5, 2006

(65) Prior Publication Data

US 2009/0120541 A1 May 14, 2009

(30) Foreign Application Priority Data

Mar. 31, 2005 (JP) ..... 2005-103090
Mar. 28, 2006 (JP) ..... 2006-089276

(51) Int. Cl.

| | |
|---|---|
| ***C22C 38/00*** | (2006.01) |
| *C22C 38/08* | (2006.01) |
| *C21D 9/08* | (2006.01) |
| *C21D 8/00* | (2006.01) |

(52) U.S. Cl.
USPC ..... 148/332; 148/336; 148/593; 148/653; 148/654

(58) Field of Classification Search
CPC ..... C21C 38/50; C21D 8/10
USPC ..... 148/336, 654
IPC ..... C21D 1/18, 8/02
See application file for complete search history.

(56) References Cited

U.S. PATENT DOCUMENTS

| | | | | |
|---|---|---|---|---|
| 4,591,396 | A | 5/1986 | Mazuda | |
| 5,310,431 | A * | 5/1994 | Buck | 148/325 |
| 5,755,895 | A | 5/1998 | Tamehiro et al. | |
| 6,264,760 | B1 * | 7/2001 | Tamehiro et al. | 148/336 |
| 6,958,099 | B2 | 10/2005 | Nakamura et al. | |
| 2005/0178456 | A1 * | 8/2005 | Tsuru et al. | 138/171 |

FOREIGN PATENT DOCUMENTS

| | | | | |
|---|---|---|---|---|
| EP | 0733715 | | 9/1996 | |
| EP | 1473376 | | 11/2004 | |
| JP | 08-311548 | A | 11/1996 | |
| JP | 09-184012 | A | 7/1997 | |
| JP | 10-017982 | A | 1/1998 | |
| JP | 10017980 | | 1/1998 | |
| JP | 11-302726 | A | 11/1999 | |
| JP | 2001335890 | A * | 12/2001 | C22C 38/00 |
| JP | 2003-293089 | A | 10/2003 | |
| WO | 03099482 | | 12/2003 | |

OTHER PUBLICATIONS

European Search Report for EP06731233 dated Jul. 7, 2011.

* cited by examiner

*Primary Examiner* — Keith Walker
*Assistant Examiner* — Alexander Polyansky
(74) *Attorney, Agent, or Firm* — RatnerPrestia

(57) ABSTRACT

The present invention provides a high-strength steel plate having excellent resistance to cutting crack, excellent Charpy absorbed energy, excellent DWTT properties, a low yield ratio, and a tensile strength of 900 MPa or more, a method of producing the steel plate, and a high-strength steel pipe using the steel plate. As solving means, a steel plate contains, by % by mass, 0.03 to 0.12% of C, 0.01 to 0.5% of Si, 1.5 to 3% of Mn, 0.01 to 0.08% of Al, 0.01 to 0.08% of Nb, 0.005 to 0.025% of Ti, 0.001 to 0.01% of N, and at least one component of 0.01 to 2% of Cu, 0.01 to 3% of Ni, 0.01 to 1% of Cr, 0.01 to 1% of Mo, and 0.01 to 0.1% of V; wherein the contents of Ca, O, and S satisfy the equation below; the microstructure includes ferrite and a second hard phase, the area fraction of ferrite being 10 to 50%; cementite in the second phase has an average grin size of 0.5 μm or less; and the total amount of Nb and the like contained in carbides thereof present in steel is 10% or less of the total content in steel.

$$1 \leq (1-130\times[O])\times[Ca]/(1.25\times[S]) \leq 3 \quad (1)$$

11 Claims, No Drawings

HIGH-STRENGTH STEEL PLATE, METHOD OF PRODUCING THE SAME, AND HIGH-STRENGTH STEEL PIPE

This application is the United States phase application of International Application PCT/JP2006/307285filed Mar. 30, 2006.

TECHNICAL FIELDS

The present invention relates to a steel plate for high-strength line pipe used for transporting natural gas and crude oil, and a method of producing the steel plate. Specifically, the present invention relates to a steel plate for low-yield-ratio, high-strength line pipe having excellent resistance to cutting cracks in cutting by shearing, excellent toughness, particularly excellent DWTT (Drop Weight Tear Test) properties, a yield ratio (obtained by dividing yield strength by tensile strength) of 0.85 or less, and a tensile strength of 900 MPa or more, a method of producing the steel plate, and a high-strength pipe produced using the steel plate.

BACKGROUND ART

Line pipes used for transporting natural gas and crude oil have recently been increased in strength every year in order to improve transportation efficiency by increasing pressure and improve field welding efficiency by decreasing thickness. Also, there have been put into practical use line pipes having high deformability (representing that large uniform elongation occurs under external stress to prevent buckling, and elongation has allowance because of a low yield ratio), i.e., a tensile strength of over 800 MPa, in order to prevent crack initiation due to local buckling even when large deformation occurs in line pipes by large earthquake or ground movement in a permafrost region. In recent years, the requirement for line pipes to have a tensile strength of over 900 MPa has been being realized.

With respect to a method of producing a steel plate for welded steel pipes for such high-strength line pipes, for example, Patent Document 1 discloses a technique in which two-step cooling is performed after hot-rolling, and the cooling stop temperature in the second step is 300° C. or less for achieving high strength.

Patent Document 2 discloses a technique relating conditions for accelerated cooling and aging heat treatment for increasing strength by Cu precipitation strengthening. Further, Patent Document 3 discloses a steel pipe having excellent resistance to buckling against compression and having an appropriate area fraction of a second phase structure according to the ratio of the pipe thickness to the external diameter, thereby exhibiting a low yield ratio.

However, like in the technique disclosed in Patent Document 1, when the cooling stop temperature is decreased to introduce a hard bainite or martensite structure which produces low-temperature transformation, thereby achieving high strength, a crack (referred to as a "cutting crack" hereinafter) occurs in a cut end surface due to diffusible hydrogen remaining in steel when the cooled steel plate is cut into a necessary size by shearing. There is demand for a steel plate having a tensile strength of less than 900 MPa to have high deformability. However, a steel plate having a yield ratio of 0.85 or less has not yet been obtained.

On the other hand, like in Patent Document 2, when heat treatment is performed after accelerated cooling, hydrogen in steel is sufficiently diffused, and thus the occurrence of a cutting crack can be suppressed. However, cementite is precipitated and coarsened in the microstructure during the heat treatment, thereby decreasing toughness and particularly degrading DWTT (Drop Weight Tear Test) properties for evaluating brittle crack arrestability. Patent Document 2 is not aimed at high deformability, and thus a yield ratio of 0.85 or less is not achieved.

Further, as described in Patent Document 3, the technique disclosed in this document is aimed at decreasing a yield ratio (YR) obtained by dividing yield strength by tensile strength in order to comply with the requirement for high deformability for preventing the occurrence of cracks even when large deformation is produced in a line pipe by large earthquake or ground movement in a permafrost region. However, in this technique, the microstructure of steel pipe is dual phase, and thus Charpy absorbed energy is decreased. Therefore, the crack arrestability of ductile fracture caused by exogenous trouble is not excellent (A brittle fracture test is performed by applying a static or dynamic load to a test piece or specimen provided with a notch or subjected to processing alternative to notching. In this test, a brittle crack is produced by impact load, and the brittle fracture arrestability is determined at each temperature.), and a tensile strength of 900 MPa or more cannot be achieved because a first phase has a ferrite structure.

[Patent Document 1] Japanese Unexamined Patent Application Publication No. 2003-293089

[Patent Document 2] Japanese Unexamined Patent Application Publication No. 08-311548

[Patent Document 3] Japanese Unexamined Patent Application Publication No. 09-184015

DISCLOSURE OF INVENTION

The present invention has been achieved in consideration of the above-mentioned situation, and a main object is to provide a high-strength steel plate and a high-strength steel pipe capable of being sheared with causing no cutting crack, the steel plate and steel pipe being provided with a low yield ratio for preventing crack initiation due to local buckling even when large deformation is produced in a line pipe by ground movement such as large earthquake. Another object is to provide a high-strength steel plate further having excellent toughness, i.e., a high-strength steel plate having excellent resistance to cutting cracks, excellent Charpy absorbed energy, excellent DWTT properties, a low yield ratio of 0.85% or less, and a tensile strength of 900 MPa or more, a method of producing the steel plate, and a high-strength steel pipe.

As a result of intensive research for resolving the problems, the inventors obtained the following findings:

1) The resistance to cutting cracks of a high-strength steel plate immediately after accelerated cooling is degraded by trapping diffusible hydrogen in steel at a trap site. In order to inhibit this, it is necessary that the hydrogen content is less than 2 ppm and thus dehydrogenation heat treatment at at least 300° C. or more is required. Specifically, reheating is started immediately after the stop of accelerated cooling, and the steel plate temperature is increased to 300° C. or more to promote hydrogen diffusion. As a result, the content of hydrogen remaining in steel is lower than 2 ppm which is a critical amount for the occurrence of cutting cracks.

2) High strength and a low yield ratio can be achieved using as a base a dual phase structure in which soft ferrite and hard bainite and/or martensite are combined. However, when carbides of Nb, Ti, Mo, and V are formed, yield strength is increased by precipitation strengthening to fail to obtain a desired low yield ratio. Thus, it is necessary to suppress the precipitation of such carbides as much as possible.

3) With the dual structure, high strength and a low yield ratio can be achieved, but the Charpy absorbed energy as an index for evaluating the crack arrestability of ductile fracture tends to decrease as compared with bainite or martensite single-phase steel having the same level of strength. However, the form of an inclusion in steel is controlled by appropriately controlling O, Ca, and S in steel, and particularly the amount of coarse MnS is decreased to achieve Charpy absorbed energy at a desired level.

4) When the average grain size of cementite present in hard bainite and/or martensite is 0.5 μm or less, the DWTT properties as an index for evaluating the brittle crack arrestability are excellent. In addition, even when steel is heated in the temperature range of 300° C. or more after accelerated cooling, cementite can be maintained in such a fine state by increasing the heating rate of reheating, thereby achieving excellent DWTT properties.

The present invention has been completed by further research on the basis of the above findings and provides the following items (1) to (5):

(1) A high-strength steel plate contains the following components:

by % by mass, 0.03 to 0.12% of C, 0.01 to 0.5% of Si, 1.5 to 3% of Mn, 0.01 to 0.08% of Al, 0.01 to 0.08% of Nb, 0.005 to 0.025% of Ti, 0.001 to 0.01% of N, 0.003% or less of O, 0.001% or less of S, and 0.0005 to 0.01% of Ca; and at least one component of 0.01 to 2% of Cu, 0.01 to 3% of Ni, 0.01 to 1% of Cr, 0.01 to 1% of Mo, and 0.01 to 0.1% of V;

wherein the contents of Ca, O, and S satisfy the equation (1) below, the balance is composed of Fe and inevitable impurities:

$$1 \leq (1-130\times[O])\times[Ca]/(1.25\times[S]) \leq 3 \quad (1)$$

wherein [O], [Ca], [S] are the contents (% by mass) of the respective elements in steel; and the steel plate further contains a microstructure in which:

the area fraction of any one of ferrite+bainite, ferrite+martensite, and ferrite+bainite+martensite is 90% or more;

the area fraction of ferrite is 10 to 50%;

cementite in bainite and/or martensite has an average grain size of 0.5 μm or less; and the total amount of Nb, Ti, Mo, and V contained in a single carbide containing at least one of Nb, Ti, Mo, and V present in steel or a composite carbide containing two or more of these elements is 10% or less of the total of Nb, Ti, Mo, and V contained in steel.

(2) The high-strength steel plate according to item (1) further contains:

by % by mass, at least one component of 0.0005 to 0.02% of REM, 0.0005 to 0.03% of Zr, and 0.0005 to 0.01% of Mg.

(3) The high-strength steel plate according to item (1) or (2), wherein cementite present in bainite and/or martensite has an average grain size of 0.2 μm or less.

(4) A method of producing a high-strength steel plate includes:

a step of heating steel containing the components described in the item (1) or (2) at 1000 to 1200° C. and then starting rolling;

a step of rolling the steel in a temperature region of 950° C. or less so that the cumulative rolling reduction (as a total number of times of rolling) is 67% or more;

a step of finishing the rolling at a temperature of $Ar_3$ point to $Ar_3$ point+100° C.;

a step of starting accelerated cooling from a temperature of $Ar_3$ point−50° C. to lower than $Ar_3$ point to lower than 250° C. at an average cooling rate of 20 to 80° C./s;

a step of finishing cooling in a temperature region of lower than 250° C.; and a step of reheating to a temperature of 300° C. to 450° C. at an average heating rate of 5° C./s or more immediately after cooling.

(5) A high-strength steel pipe includes:

the high-strength steel plate described in any one of the items (1) to (3).

In the present invention, "high strength" represents a tensile strength of 900 MPa or more, "high toughness" represents a Charpy absorbed energy of 200 J or more at a test temperature of −30° C. and a shear area of 75% or more in DWTT at a test temperature of −30° C., and "low yield ratio" represents a yield ratio of 0.85 or less. The steel plate intended in the present invention is a steel plate having a thickness of 10 mm or more.

According to the present invention, it is possible to obtain a high-strength steel plate having excellent resistance to cutting cracks, excellent Charpy absorbed energy, excellent DWTT properties, a low yield ratio of 0.85 or less, and a tensile strength of 900 MPa or more. Therefore, the present invention is very useful in the industrial field.

BEST MODE FOR CARRYING OUT THE INVENTION

The present invention will be described in detail below with respect to the composition, the structure, and the production method.

[Composition]

First, the composition of a high-strength steel plate of the present invention will be described. Hereinafter, "%" represents "% by mass".

C: Preferably 0.03 to 0.12%

C contributes to an increase in strength due to supersaturation solid solution in a low-temperature transformation structure. In order to obtain this effect, it is necessary that the C content is 0.03% or more. However, when the C content exceeds 0.12%, in processing a pipe, the hardness of the girth welded portion of the pipe is significantly increased, thereby easily causing cold cracking. Therefore, the C content is 0.03 to 0.12%.

Si: Preferably 0.01 to 0.5%

Si functions as a deoxidizer and an element for increasing the strength of a steel material by solid solution strengthening. When the Si content is less than 0.01%, the effect cannot be obtained, while when the Si content exceeds 0.5%, toughness is significantly decreased. Therefore, the Si content is 0.01 to 0.5%.

Mn: Preferably 1.5 to 3%

Mn functions as a hardenability improving element. The effect is exhibited when the Mn content is 1.5% or more. However, the concentration in a central segregated portion is significantly increased in a continuous casting process, and thus when the Mn content exceeds 3%, delayed failure is caused in the segregated portion. Therefore, the Mn content is in the range of 1.5 to 3%.

Al: Preferably 0.01 to 0.08%

Al functions as a deoxidizing element. When the Al content is 0.01% or more, the sufficient deoxidizing effect is obtained, while when the Al content exceeds 0.08%, the index of cleanliness of steel is decreased, thereby degrading toughness. Therefore, the Al content is 0.01 to 0.08%.

Nb: Preferably 0.01 to 0.08%

Nb has the effect of enlarging a non-recrystallized austenite region in hot rolling, and particularly a region of 950° C. or less becomes the non-recrystallized region. Therefore, the Nb content is 0.01% or more. However, when the Nb content exceeds 0.08%, HAZ toughness after welding is significantly degraded. Therefore, the Nb content is 0.01 to 0.08%.

Ti: Preferably 0.005 to 0.25%

Ti forms a nitride and is effective for decreasing the amount of N dissolved in steel and also suppresses coarsening of austenite grains by the pinning effect of precipitated TiN to contribute to improvement in HAZ toughness of a base material. In order to obtain the necessary pinning effect, it is necessary that the Ti content is 0.005% or more. However, when the Ti content exceeds 0.025%, a carbide is formed, thereby significantly degrading toughness by precipitation hardening. Therefore, the Ti content is 0.005 to 0.25%.

N: Preferably 0.001 to 0.01%

N is generally present as an inevitable impurity but forms TiN which suppresses coarsening of austenite grains by adding Ti as described above. In order to obtain the necessary pinning effect, it is necessary that the N content is 0.001% or more. However, when the N content exceeds 0.01%, TiN is decomposed in HAZ heated at 1450° C. or more near a welded portion, particularly a fusion line, thereby causing the significantly adverse effect of solid solution N. Therefore, the N content is 0.001 to 0.01%.

At least one of Cu, Ni, Cr, Mo, and V

Any one of Cu, Ni, Cr, Mo, and V functions as a hardenability improving element and thus at least one of these elements is contained in the range described below for increasing strength.

Cu: Preferably 0.01 to 2%

Cu contributes to improvement in hardenability of steel at a content of 0.01% or more. However, when the Cu content exceeds 2%, toughness is degraded. Therefore, when Cu is added, the Cu content is 0.01 to 2%.

Ni: Preferably 0.01 to 3%

Ni contributes to improvement in hardenability of steel at a content of 0.01% or more. In particular, the addition of a large amount of Ni causes no deterioration of toughness, and thus Ni is effective for increasing toughness. However, Ni is an expensive element, and the effect of Ni is saturated at a Ni content of over 3%. Therefore, when Ni is added, the Ni content is 0.01 to 3%.

Cr: Preferably 0.01 to 1%

Cr contributes to improvement in hardenability of steel at a content of 0.01% or more. However, when the Cr content exceeds 1%, toughness is degraded. Therefore, when Cr is added, the Cr content is 0.01 to 1%.

Mo: Preferably 0.01 to 1%

Mo contributes to improvement in hardenability of steel at a content of 0.01% or more. However, when the Mo content exceeds 1%, toughness is degraded. Therefore, when Mo is added, the Mo content is 0.01 to 1%.

V: Preferably 0.01 to 0.1%

V forms a carbonitride to cause precipitation strengthening and particularly contributes to the prevention of softening of a welded heat affected zone. This effect is obtained at a content of 0.01% or more, but when the V content exceeds 0.1%, precipitation strengthening significantly occurs to decrease toughness. Therefore, when V is added, the V content is 0.01 to 0.1%.

Ca: Preferably 0.0005 to 0.01%

In a steel making process, when the Ca content is less than 0.0005%, it is difficult to secure CaS by deoxidation reaction control, and thus the toughness improving effect cannot be obtained. On the other hand, when the Ca content exceeds 0.01%, coarse CaO easily occurs to decrease toughness of a base metal and cause nozzle blockage of a ladle, thereby inhibiting productivity. Therefore, the Ca content is 0.0005 to 0.01%.

O: Preferably 0.003% or less, S: 0.001% or less

In the present invention, O and S are inevitable impurities, and the upper limits of the contents are specified. The O content is 0.003% or less from the viewpoint of suppressing the occurrence of a coarse inclusion which adversely affects toughness.

In addition, the occurrence of MnS is suppressed by adding Ca, but at a high S content, the occurrence of MnS cannot be sufficiently suppressed even by controlling the form using Ca. Therefore, the S content is 0.001% or less.

$$1 \leq (1-130\times[O])\times[Ca]/(1.25\times[S]) \leq 3$$

The parameter equation defines the relationship between the O and S contents and the Ca content in steel in order to obtain excellent toughness. When this range is satisfied, the occurrence of a coarse inclusion which adversely affects toughness is suppressed, and coarsening of CaO.CaS produced by adding excessive Ca is suppressed, thereby preventing a decrease in Charpy absorbed energy.

The relationship is described in further detail.

Ca has the sulfide forming ability and suppresses the occurrence of MnS which decreases Charpy absorbed energy in molten steel in steel making and forms CaS instead which is relatively harmless to toughness. However, Ca is also an oxide forming element, and thus it is necessary to add Ca making allowance for consumption as an oxide. Namely, from the viewpoint of suppressing the occurrence of a coarse inclusion which adversely affects toughness, $0 \leq 0.003\%$ and $S \leq 0.001\%$ are established, and the effective CaO amount ($Ca^*$) excluding the CaO forming component is defined as the equation (a) below by regression of experimental results. Further, as shown in the equation (b) below, when Ca is added so that the value obtained by dividing the effective $Ca^*$ amount by the Ca/S stoichiometric ratio 1.25 is the S content in steel, S in steel is completely consumed for forming CaS.

$$Ca^* = (1-130\times[O])\times[Ca] \quad (a)$$

$$[S] \leq Ca^*/1.25 \quad (b)$$

On the other hand, it was also found that when the Ca content is excessive, produced CaO.CaS is coarsened to decrease Charpy absorbed energy. The results of laboratory examination indicate that in order to suppress coarsening of Ca, it is necessary to satisfy the following equation (c):

$$3\cdot[S] \geq Ca^*/1.25 \quad (c)$$

On the basis of the above examination results, the range between the equations (b) and (c) is defined as the following equation (1):

$$1 \leq (1-130\times[O])\times[Ca]/(1.25\times[S]) \leq 3 \quad (1)$$

In the equations (1) and (a) to (c), [O], [Ca], and [S] represent the contents (% by mass) of the respective elements in steel.

At least one of REM, Zr, and Mg

From the viewpoint of further improving toughness of a welded portion, in addition to the basic components, these elements are added according to demand.

REM: 0.0005 to 0.02%

REM forms an oxysulfide in steel, and at a REM content of 0.0005% or more, REM exhibits the pinning effect of preventing coarsening of a welded heat affected zone. However, REM is an expensive element, and its effect is saturated even when the content exceeds 0.2%. Therefore, when REM is added, the REM content is 0.0005 to 0.02%.

Zr: 0.0005 to 0.03%

Zr forms a carbonitride in steel, and particularly exhibits the pinning effect of preventing coarsening of austenite grains in a welded heat affected zone. In order to obtain the sufficient pinning effect, it is necessary to add 0.0005% or more of Zr. However, when the Zr content exceeds 0.03%, the index of cleanliness in steel is significantly decreased to decrease toughness. Therefore, when Zr is added, the Zr content is 0.0005 to 0.03%.

Mg: 0.0005 to 0.01%

Mg forms a fine oxide in steel in a steel making process, and particularly exhibits the pinning effect of preventing coarsening of austenite grains in a welded heat affected zone. In order to obtain the sufficient pinning effect, it is necessary to add 0.0005% or more of Mg. However, when the Mg content exceeds 0.01%, the index of cleanliness in steel is significantly decreased to decrease toughness. Therefore, when Mg is added, the Mg content is 0.0005 to 0.01%.

[Microstructure]

Next, the microstructure will be described.

Any one of ferrite+bainite, ferrite+martensite, and ferrite+bainite+martensite at an area fraction of 90% or more A dual phase structure including a soft ferrite phase and a hard phase is formed to increase tensile strength and decrease yield strength, thereby satisfying both high strength and low yield ratio. In order to achieve a strength of 900 MPa or more, the hard phase includes bainite or martensite, or a mixed structure thereof. In other words, any one of ferrite+bainite, ferrite+martensite, and ferrite+bainite+martensite is formed. When the total area fraction of ferrite and the hard phase is 90% or more, desired strength and yield ratio can be obtained. The total area fraction is preferably 95% or more. Namely, the presence of less than 10% of residual γ, M-A constituent, and perlite is allowable. From the viewpoint of toughness, bainite and/or martensite constituting the hard phase preferably has a structure transformed from fine grain austenite having a grain size of 30 μm or less in the thickness direction of the plate.

Ferrite at an area fraction of 10 to 50%

When the area fraction of ferrite is less than 10%, the behavior is substantially the same as that of a bainite or martensite single-phase structure, and yield strength remains high, thereby causing difficulty in achieving a desired low yield ratio. On the other hand, when the area fraction of ferrite exceeds 50%, the structure mainly includes soft ferrite to decrease tensile strength, thereby causing difficulty in achieving a high strength over 900 MPa. The area fraction is preferably 10 to 30%. At the area fraction of 30% or less, high tensile strength can be stably obtained. Further, from the viewpoint of improving toughness, ferrite grains are fine grains having an average grain size of 20 μm or less.

Cementite having an average grain size of 0.5 μm or less in bainite and/or martensite Cementite is precipitated in the hard phase, i.e., bainite and/or martensite, by tempering for preventing cutting cracks. When cementite is coarsened to over 0.5 μm by tempering conditions, the DWTT properties deteriorate, and Charpy absorbed energy is decreased. Therefore, cementite in bainite and/or martensite has an average grain size of 0.5 μm or less. In particular, when the average grain size of cementite is 0.2 μm or less to further suppress coarsening, the Charpy absorbed energy can be further increased. Therefore, the average grain size of cementite is preferably 0.2 μm or less. The average grain size of cementite is measured by the following method: First, a sample for microstructure observation is obtained in parallel with a section taken along the rolling direction of the plate, polished, treated by speed etching, and then observed through a scanning electron microscope to obtain micrographs in random 10 fields of view. The equivalent circle diameter of each cementite grain is calculated from the micrographs by image analysis, and an average is calculated.

Nb, Ti, Mo, and V contained in a single carbide containing at least one of Nb, Ti, Mo, and V present in steel or a composite carbide containing two or more of these elements in a total amount of 10% or less (% by mass) of the total of Nb, Ti, Mo, and V contained in steel Besides cementite, Nb, Ti, Mo, and V carbides are precipitated in steel by tempering for preventing shear cracking. When the total amount of the element carbides precipitated exceeds 10% of the total content of the elements in steel, precipitation strengthening occurs, and particularly yield strength is increased, thereby causing difficulty in achieving the desired value of low yield ratio. Therefore, the total amount of the carbides of the carbide forming elements is 10% or less.

[Production Conditions]

Next, the production conditions will be described.

(1) Hot Rolling

Slab heating temperature: 1000 to 1200° C.

In hot rolling, in order to transform the entire slab to austenite, it is necessary to heat the slab to 1000° C. or more. On the other hand, when the steel slab is heated to a temperature over 1200° C., austenite grains are grown even if TiN pinning, and thus the toughness of the base metal is degraded. Therefore, the slab heating temperature is 1000 to 1200° C.

Cumulative rolling reduction in a temperature region of 950° C. or less: 67% or more As described above, a region of 950° C. or less is a not-recrystallized austenite region due to Nb addition. In this temperature region, austenite grains are extended by cumulative large rolling reduction (total number of times of rolling reduction), and the grains are made fine particularly in the plate thickness direction. In this state, accelerated cooling produces steel having excellent toughness. However, when the cumulative rolling reduction is less than 67%, the effect of making fine grains is insufficient, and it is difficult to obtain the effect of improving steel toughness. Therefore, the cumulative rolling reduction is 67% or more. In order to further improve the toughness improving effect, the cumulative rolling reduction is preferably in the range of 75% or more.

Rolling finish temperature: $Ar_3$ point to $Ar_3$ point+100° C.

When the rolling finish temperature is lower than the $Ar_3$ point, rolling is performed in the ferritic transformation range, and ferrite produced by transformation is greatly processed to decrease the Charpy absorbed energy. On the other hand, when rolling is finished at a high temperature higher than $Ar_3$ point+100° C., the effect of making fine grains due to rolling in the non-recrystallized austenite zone is insufficient. While when rolling is finished in the range of $Ar_3$ point to $Ar_3$ point+100° C., the effect of making fine grains due to rolling in the non-recrystallized austenite zone can be sufficiently secured. Therefore, the rolling finish temperature is $Ar_3$ point to $Ar_3$ point+100° C.

(2) Accelerated Cooling

Cooling start temperature of accelerated cooling: $Ar_3$ point−50° C. to lower than $Ar_3$ point In order to realize a low yield ratio, it is necessary to form soft ferrite by transformation. However, ferrite transformation is suppressed by accelerated cooling, and thus ferrite is transformed in an air-cooling process after hot rolling until accelerated cooling is started. Therefore, the start temperature of accelerated cooing is lower than $Ar_3$ point. On the other hand, when the cooling start temperature is lower than $Ar_3$ point−50° C., the area fraction of ferrite exceeds 50%, and thus necessary tensile strength cannot be secured. Therefore, the lower limit is $Ar_3$ point−50° C.

Average cooling rate of accelerated cooling: 20 to 80° C./s

In order to obtain the hard second phase structure including bainite and/or martensite, accelerated cooling is performed at 20° C./s or more. On the other hand, even when the cooling rate exceeds 80° C./s, the resultant structure is the same, and the material quality is saturated. Therefore, the upper limit is 80° C./s. The cooling rate represents the average cooing rate of a central portion of the plate (a value obtained by dividing a difference between the cooling start temperature and the cooling stop temperature by the time required).

Cooling stop temperature of accelerated cooling: 250° C. or less

In order to increase the strength of the steel plate, the stop temperature of accelerated cooling is decreased to form a bainite or martensite structure which transforms at a low temperature. When the cooling stop temperature exceeds 250° C., accelerated cooling is stopped while transformation is insufficient, and the structure remaining untransformed is coarse and decreases toughness. Therefore, the cooling stop temperature is 250° C. or less.

(3) Reheat Treatment

In the steel plate strengthened by low-temperature transformation by accelerated cooling, diffusible hydrogen in steel remains after air cooling after accelerated cooling to produce cutting cracks. Therefore, reheat treatment is performed immediately after the stop of accelerated cooling. The reheat treatment may be performed by any method such as furnace heating and induction heating. The conditions for the reheat treatment are important for obtaining the characteristics of the steel plate of the present invention.

Heating temperature: 300 to 450° C.

When the reheat temperature is lower than 300° C., hydrogen is not sufficiently diffused to fail to prevent cutting cracks. Therefore, the reheat temperature is 300° C. or more. On the other hand, in order to obtain a yield ratio of 0.85 or less, it is necessary to suppress an increase in yield strength. Thus, the upper limit temperature is 450° C. so as to prevent an increase in precipitation strengthening due to an increase in amount of Nb, Ti, Mo, and V carbides precipitated in reheating.

Average heating rate: 5° C./s or more

When steel is reheated immediately after accelerated cooling is stopped, carbon in the form of a supersaturation solid solution in bainite or martensite, which is produced by transformation by accelerated cooling, is homogeneously and finely precipitated as cementite. In addition, cementite tends to aggregate and coarsen from a temperature region higher than 300° C. In order to evaluate toughness of the high-strength steel plate, the DWTT properties for brittle crack arrestability are evaluated. In particular, as a result of research on the properties, the inventors of the present invention found that in order to obtain the excellent DWTT properties, it is effective to increase the heating rate to suppress the aggregation process and inhibit coarsening of cementite. Therefore, it was found that when the heating rate is 5° C./s or more, cementite can be maintained in a fine state immediately after precipitation, thereby achieving the excellent DWTT properties. Therefore, the heating rate is 5° C./s or more. The heating rate represents the average heating rate of a central portion of the steel plate (a value obtained by dividing a difference between the reheating start temperature and the reheating temperature by the time required).

Reheating start time: immediately after the stop of reheating and cooling

When the time required until reheating is long, hydrogen diffusion becomes difficult due to a temperature drop in the air-cooling process, and at a temperature of 100° C., hydrogen is little diffused. Therefore, reheating is started immediately after the stop of accelerated cooling. The heating start time is preferably within 300 seconds and more preferably 100 seconds after the stop of accelerated cooling.

In the present invention, the $Ar_3$ point is the start temperature of ferrite transformation in the cooling process after rolling of the steel plate, and is preferably calculated from the content (% by mass) of each element in steel using $Ar_3$=910−310C−80Mn−20Cu−55Ni−15Cr−80Mo. However, the $Ar_3$ point is not particularly defined.

The high-strength steel plate of the present invention can be formed into a high-strength steel pipe used for line pipe by forming into a pipe according to a general method and welding the ends of pipes.

EXAMPLES

Steel plates A to K were produced using steels having the chemical compositions shown in Table 1 under the hot rolling, accelerated cooling, and reheating conditions shown in Table 2. Reheating was performed using an induction heating apparatus installed on the same line as that of an accelerated cooling apparatus.

TABLE 1

(mass %)

| Steel type | C | Si | Mn | Al | Nb | Ti | N | Cu | Ni | Cr | Mo |
|---|---|---|---|---|---|---|---|---|---|---|---|
| A | 0.035 | 0.10 | 2.10 | 0.030 | 0.031 | 0.012 | 0.004 | 0.40 | 0.40 | 0.05 | 0.22 |
| B | 0.042 | 0.10 | 2.04 | 0.030 | 0.030 | 0.012 | 0.004 | 0.40 | 0.70 | 0.20 | 0.40 |
| C | 0.045 | 0.10 | 1.95 | 0.030 | 0.033 | 0.011 | 0.004 | 0.20 | 0.40 | 0.30 | 0.40 |
| D | 0.048 | 0.09 | 2.21 | 0.030 | 0.025 | 0.010 | 0.003 | 0.40 | 0.70 | 0.50 | 0.40 |
| E | 0.052 | 0.11 | 2.12 | 0.030 | 0.028 | 0.012 | 0.004 | 0.40 | 0.90 | 0.20 | 0.20 |
| F | 0.065 | 0.10 | 2.05 | 0.030 | 0.030 | 0.010 | 0.003 | 0.50 | 0.60 | 0.20 | 0.20 |
| G* | 0.130* | 0.10 | 2.05 | 0.030 | 0.030 | 0.012 | 0.004 | 0.40 | 0.40 | 0.20 | 0.20 |
| H* | 0.046 | 0.11 | 1.40* | 0.030 | 0.032 | 0.012 | 0.004 | 0.50 | 0.45 | 0.20 | 0.20 |
| J* | 0.051 | 0.12 | 2.08 | 0.030 | 0.031 | 0.011 | 0.004 | 0.40 | 0.90 | 0.20 | 0.20 |
| K* | 0.053 | 0.09 | 2.13 | 0.030 | 0.029 | 0.011 | 0.003 | 0.40 | 0.90 | 0.20 | 0.20 |

TABLE 1-continued (mass %)

| Steel type | V | Ca | S | O | REM | Zr | Mg | Equation(1) | $Ar_3$ |
|---|---|---|---|---|---|---|---|---|---|
| A | 0.041 | 0.0018 | 0.0005 | 0.002 | — | — | — | 2.1 | 683 |
| B | 0.045 | 0.0016 | 0.0004 | 0.002 | — | — | — | 2.4 | 652 |
| C | 0.040 | 0.0012 | 0.0006 | 0.002 | — | — | — | 1.2 | 678 |
| D | 0.040 | 0.0015 | 0.0005 | 0.002 | 0.0015 | — | — | 1.8 | 632 |
| E | 0.045 | 0.0018 | 0.0004 | 0.002 | — | 0.0018 | — | 2.7 | 648 |
| F | 0.042 | 0.0012 | 0.0003 | 0.002 | — | — | 0.0014 | 2.4 | 664 |
| G* | 0.036 | 0.0016 | 0.0008 | 0.002 | — | — | — | 1.2 | 657 |
| H* | 0.040 | 0.0018 | 0.0008 | 0.002 | — | — | — | 1.3 | 730 |
| J* | 0.043 | 0.0021 | 0.0028* | 0.002 | — | — | — | 0.4* | 651 |
| K* | 0.044 | 0.0038 | 0.0008 | 0.001 | — | — | — | 3.3* | 647 |

Note 1:
Mark * represents a content out of the range of the present invention.
Note 2:
Equation(1): $1 \leq (1 - 130 \times [O]) \times [Ca]/(1.25 \times [S]) \leq 3$ [O], [Cu], and [S] represent contents.
Note 3:
$Ar_3$ ° C. = 910-310C—80Mn—20Cu—55Ni—15Cr—80Mo C, Mn, Cu, Ni, Cr, Mo represent contents.

TABLE 2

| No. | Steel type | Plate thickness (mm) | Heating temperature (° C.) | Cumurative rolling reduction at 950° C. or less (° C.) | Rolling finish temperature (° C.) | Cooling start temperature (° C.) |
|---|---|---|---|---|---|---|
| 1 | A | 15 | 1180 | 75 | 740 | 660 |
| 2 | B | 15 | 1180 | 80 | 720 | 640 |
| 3 | C | 15 | 1180 | 75 | 730 | 660 |
| 4 | C | 15 | 1180 | 75 | 720 | 650 |
| 5 | C | 15 | 1180 | 75 | 720 | 670 |
| 6 | D | 15 | 1180 | 70 | 700 | 610 |
| 7 | E | 20 | 1150 | 75 | 720 | 620 |
| 8 | F | 20 | 1150 | 75 | 750 | 620 |
| 9 | C | 15 | 1180 | 75 | 660* | 620* |
| 10 | C | 15 | 1180 | 75 | 750 | 700* |
| 11 | C | 15 | 1180 | 75 | 720 | 650 |
| 12 | C | 15 | 1180 | 75 | 710 | 640 |
| 13 | C | 15 | 1180 | 75 | 720 | 650 |
| 14 | C | 15 | 1180 | 75 | 720 | 650 |
| 15 | C | 15 | 1180 | 75 | 720 | 650 |
| 16 | G* | 20 | 1150 | 75 | 700 | 640 |
| 17 | H* | 15 | 1150 | 80 | 760 | 700 |
| 18 | J* | 15 | 1150 | 75 | 730 | 630 |
| 19 | K* | 15 | 1150 | 75 | 730 | 630 |

| No. | Cooling rate (° C./s) | Cooling stop temperature (° C.) | Time required to start of reheating (s) | Heating reate (° C./s) | Reheating temperature (° C.) | Remarks |
|---|---|---|---|---|---|---|
| 1 | 45 | 200 | 90 | 8 | 350 | This invention |
| 2 | 45 | 200 | 95 | 7 | 400 | example |
| 3 | 50 | 200 | 80 | 7 | 350 | |
| 4 | 45 | 200 | 90 | 8 | 400 | |
| 5 | 50 | 200 | 85 | 10 | 450 | |
| 6 | 45 | 200 | 90 | 7 | 350 | |
| 7 | 35 | 200 | 95 | 7 | 400 | |
| 8 | 40 | 200 | 90 | 8 | 400 | |
| 9 | 45 | 200 | 100 | 8 | 350 | Comparative |
| 10 | 45 | 200 | 95 | 10 | 350 | example |
| 11 | 50 | 300* | 100 | 7 | 480* | |
| 12 | 45 | 200 | 85 | 0.5* | 450 | |
| 13 | 50 | 200 | 330* | 8 | 300 | |
| 14 | 50 | 200 | 95 | 6 | 250* | |
| 15 | 45 | 200 | 90 | 7 | 550* | |
| 16 | 40 | 200 | 95 | 7 | 350 | |
| 17 | 45 | 200 | 100 | 10 | 400 | |
| 18 | 40 | 200 | 95 | 7 | 350 | |
| 19 | 40 | 200 | 90 | 7 | 350 | |

Note:
Mark * represents a content out of the range of the present invention.

Each of the steel plates was cut at 20 positions with a shearing machine, and then the cut surfaces of each steel plate were examined by magnetic particle inspection to measure the number of cut surfaces on which cutting cracks were observed. In this test, even when a plurality of cracks was observed in an end surface, the number of occurrences of cutting cracks was regarded as "1" because of one end surface. When cutting cracks were not observed in all cut positions (the number of occurrences of cutting cracks was zero), the result was evaluated as "good".

Next, in order to evaluate strength and toughness of each of the resultant steel plates, an overall thickness tensile specimen and a DWTT specimen were obtained according to API-5L, and a V-notch Charpy impact specimen according to JIS Z2202 (1980) was obtained from a central position in the thickness direction of the steel plate. Then, a tensile test, a DWTT test (test temperature −30° C.), and a Charpy impact test (test temperature −30° C.) of the steel plate were conducted. In addition, a sample for microstructure observation was obtained in parallel with a section taken along the rolling direction of the plate, polished, etched with nitric acid and alcohol, and then observed through an optical microscope to observe the structure to examine the type of the microstructure of steel (in Table 3, F: ferrite, B: bainite M: martensite). Next, the sample was again polished, treated by speed etching, and then observed through a scanning electron microscope to obtain micrographs in random ten fields of view. The equivalent circle diameter of each cementite grains is calculated from the micrographs by image analysis, and an average is calculated. The results of the shearing test of the steel plates and the results of the strength/toughness test of the base metals are shown in Table 3 (the results of a steel pipe produced using steel type A were substantially the same as those of the steel plates).

TABLE 3

| No. | Steel type | Plate thickness (mm) | Base metal microstructure: F fraction (%) | Base metal microstructure: B + M fraction (%) | Base metal microstructure: Other (%) | Cementite average grain size (μm) | Ratio of total of Nb, Ti, Mo, and V contained in carbides of Nb, Ti, Mo, and V to total adding amount (%) |
|---|---|---|---|---|---|---|---|
| 1 | A | 15 | 20 | 75 | 5(M-A constituent) | 0.1 | 5.2 |
| 2 | B | 15 | 15 | 80 | 5(M-A constituent) | 0.2 | 4.3 |
| 3 | C | 15 | 15 | 85 | — | 0.1 | 3.9 |
| 4 | C | 15 | 25 | 75 | — | 0.2 | 4.4 |
| 5 | C | 15 | 12 | 85 | — | 0.2 | 8.3 |
| 6 | D | 15 | 15 | 85 | — | 0.2 | 3.6 |
| 7 | E | 20 | 30 | 70 | — | 0.2 | 5.6 |
| 8 | F | 20 | 40 | 60 | — | 0.3 | 5.2 |
| 9 | C | 15 | 52* | 45 | 3(perlite) | 0.1 | 4.2 |
| 10 | C | 15 | 0* | 100 | — | 0.1 | 4.1 |
| 11 | C | 15 | 25 | 70 | 5(M-A constituent) | 0.4 | 10.4* |
| 12 | C | 15 | 30 | 65 | 5(M-A constituent) | 0.9* | 7.9 |
| 13 | C | 15 | 30 | 70 | — | 0.7 | 3.9 |
| 14 | C | 15 | 25 | 75 | — | 0.1 | 3.4 |
| 15 | C | 15 | 20 | 75 | 5(perlite) | 0.6* | 16.7* |
| 16 | G* | 20 | 15 | 85 | — | 0.4 | 5.1 |
| 17 | H* | 15 | 30 | 60 | 10(perlite) | 0.1 | 5.9 |
| 18 | J* | 15 | 25 | 75 | — | 0.2 | 4.2 |
| 19 | K* | 15 | 20 | 80 | — | 0.2 | 3.7 |

| No. | Number of occurrences of cutting crack | Base metal yield strength (MPa) | Base metal tensile strength (MPa) | Base metal yield ratio | Base metal toughness: vE-30 (J) | Base metal toughness: DWTT SA-30 (%) | Remarks |
|---|---|---|---|---|---|---|---|
| 1 | 0 | 788 | 935 | 0.84 | 285 | 100 | This |
| 2 | 0 | 784 | 948 | 0.83 | 258 | 95 | invention |
| 3 | 0 | 784 | 942 | 0.83 | 264 | 95 | example |
| 4 | 0 | 820 | 960 | 0.85 | 244 | 95 | |
| 5 | 0 | 814 | 954 | 0.85 | 253 | 95 | |
| 6 | 0 | 825 | 985 | 0.84 | 234 | 90 | |
| 7 | 0 | 816 | 982 | 0.83 | 242 | 90 | |
| 8 | 0 | 864 | 1026 | 0.84 | 215 | 90 | |
| 9 | 0 | 710 | 845* | 0.84 | 245 | 90 | Comparative |
| 10 | 0 | 865 | 950 | 0.91* | 165* | 65* | example |
| 11 | 0 | 855 | 930 | 0.92* | 146* | 85 | |
| 12 | 0 | 805 | 945 | 0.85 | 168* | 45* | |
| 13 | 7* | 791 | 951 | 0.83 | 231 | 90 | |
| 14 | 10* | 812 | 968 | 0.84 | 236 | 85 | |
| 15 | 0 | 823 | 882* | 0.93* | 191* | 75* | |
| 16 | 6* | 845 | 1085 | 0.78 | 188* | 85 | |
| 17 | 0 | 745 | 875* | 0.85 | 265 | 95 | |

TABLE 3-continued

| | | | | | | |
|---|---|---|---|---|---|---|
| 18 | 0 | 803 | 947 | 0.85 | 145* | 90 |
| 19 | 0 | 809 | 979 | 0.85 | 164* | 90 |

Note:
Mark * represents a content out of the range of the present invention.

In Examples 1 to 8 of this invention in each of which the chemical composition and the rolling, cooling, and reheating conditions are within the ranges of the present invention, no cutting crack occurred, and high strength, high toughness, and a low yield ratio were exhibited.

On the other hand, in the comparative examples out of the range of the present invention, any one of the properties was inferior. Specifically, in Comparative Example 9 in which the rolling finish temperature is lower than the range of the present invention, the fraction of the ferrite structure was increased to decease strength. In Comparative Example 10 in which the cooling start temperature is higher than the range of the present invention, ferrite transformation at the $Ar_3$ point or less did not occur, thereby increasing the yield ratio and decreasing the Charpy absorbed energy and DWTT properties. In Comparative Example 11 in which the cooling stop temperature is higher than the range of the present invention, and the reheating temperature exceeds the upper limit, the bainite structure was obtained, but was not transformed at a low temperature to produce a coarse structure. As a result, the Charpy absorbed energy was decreased, and a carbide was precipitated in reheating, thereby increasing the yield ratio (YR). In Comparative Example 12 in which the reheating rate is lower than the range of the present invention, cementite was coarsened to decrease the Charpy absorbed energy and DWTT properties. In Comparative Example 13 in which the time required until the start of reheating exceeds 300 seconds, a cutting crack occurred. In Comparative Example 14 in which the reheating temperature is lower than the range of the present invention, dehydrogenation did not sufficiently occur due to the excessively low heating temperature, and thus many cutting cracks occurred. In Comparative Example 15 in which the reheating temperature is higher than the range of the present invention, the amount of the carbide precipitated was increased to cause precipitation strengthening, thereby increasing the yield ratio (YR). In Comparative Example 16 using steel type G in which the C content in the steel plate is higher than the range of the present invention, high strength was exhibited, but the density of cementite was excessively increased to cause a cutting crack and the Charpy absorbed energy was low. In Comparative Example 17 using steel type H in which the Mn content is the steel plate is lower than the range of the present invention, the strength was decreased. In Comparative Example 18 using steel type J in which the S content in the steel plate exceeds the upper limit and does not satisfy the relation defined by the equation (1), a MnS-based inclusion was present, and the degree of cleanliness was low, thereby decreasing the Charpy absorbed energy. In Comparative Example 19 using steel type K in which each of the chemical components is within the range of the present invention, but the relation defined by the equation (1) is not satisfied, the occurrence of a MnS inclusion was suppressed, but Ca became excessive to decrease the degree of cleanliness by a Ca-based inclusion, thereby decreasing the Charpy absorbed energy.

Industrial Applicability

The present invention provides a high-strength steel plate having excellent resistance to cutting crack, excellent Charpy absorbed energy, excellent DWTT properties, a low yield ratio of 0.85 or less, and a tensile strength of 900 MPa or more, and is thus suitable for line pipes for transporting natural gas and crude oil.

The invention claimed is:

1. A high-strength steel plate comprising a steel having the following components:

by % by mass, 0.03 to 0.12% of C, 0.01 to 0.5% of Si, 1.5 to 3% of Mn, 0.01 to 0.08% of Al, 0.01 to 0.08% of Nb, 0.005 to 0.025% of Ti, 0.001 to 0.01% of N, 0.003% or less of O, 0.001% or less of S, and 0.0005 to 0.01% of Ca; and at least one component of 0.01 to 2% of Cu, 0.01 to 3% of Ni, 0.01 to 1% of Cr, 0.01 to 1% of Mo, and 0.01 to 0.1% of V;

wherein the contents of Ca, O, and S satisfy the equation (1) below, and the balance is composed of Fe and inevitable impurities;

$1 \leq (1-130\times[O])\times[Ca]/(1.25\times[S]) \leq 3$ . . . (1) wherein [O], [Ca], [S] are the contents (% by mass) of the respective elements in steel; and having a tensile strength of at least 900 MPa, an impact energy by a Charpy V notch test at −30° C. of 200 J or more, and a shear area by a DWTT test at −30° C. of 75% or more, and the steel plate further contains a microstructure in which:

the area fraction of any one of ferrite+bainite, ferrite+martensite, and ferrite+bainite+martensite is 90% or more;

the area fraction of ferrite is 10 to 30%;

cementite in bainite and/or martensite has an average grin size of 0.5 μm or less; and the total amount of Nb, Ti, Mo, and V contained in a single carbide containing at least one of Nb, Ti, Mo, and V present in steel or a composite carbide containing two or more of these elements is 10% or less of the total of Nb, Ti, Mo, and V contained in steel.

2. The high-strength steel plate according to claim 1 further comprising:

by % by mass, at least one component of 0.0005 to 0.02% of REM, 0.0005 to 0.03% of Zr, and 0.0005 to 0.01% of Mg.

3. The high-strength steel plate according to claim 1, wherein the impact energy by the Charpy V notch test at −30° C. is greater than 234 J, and wherein the cementite present in one of bainite, martensite, or bainite and martensite has an average grain size of 0.2 μm or less.

4. A method of producing a high-strength steel plate comprising:

a step of heating steel containing the components described in claim 1 at 1000 to 1200° C. and then starting rolling;

a step of rolling the steel in the temperature region of 950° C. or less so that the cumulative rolling reduction is 67% or more;

a step of finishing the rolling at a temperature of $Ar_3$ point to $Ar_3$ point+100° C.;

a step of starting accelerated cooling from a temperature of $Ar_3$ point−50° C. to lower than $Ar_3$ point at a cooling rate of 20 to 80° C./s;

a step of finishing cooling in the temperature region of lower than 250° C.; and a step of reheating to a temperature of 300° C. to 450° C. at an average heating rate of 5° C./s or more immediately after cooling.

5. A high-strength steel pipe comprising the high-strength steel plate according to claim 1.

6. The high-strength steel plate according to claim 2, wherein cementite present in one of bainite, martensite, or bainite and martensite has an average grain size of 0.2 μm or less.

7. A method of producing a high-strength steel plate comprising:

a step of heating steel containing the components described in claim 2 at 1000 to 1200° C. and then starting rolling;

a step of rolling the steel in the temperature region of 950° C. or less so that the cumulative rolling reduction is 67% or more;

a step of finishing the rolling at a temperature of $Ar_3$ point to $Ar_3$ point+100° C.;

a step of starting accelerated cooling from a temperature of $Ar_3$ point−50° C. to lower than $Ar_3$ point at a cooling rate of 20 to 80° C./s;

a step of finishing cooling in the temperature region of lower than 250° C.; and a step of reheating to a temperature of 300° C. to 450° C. at an average heating rate of 5° C./s or more immediately after cooling.

8. A high-strength steel pipe comprising the high-strength steel plate according to claim 2.

9. A high-strength steel pipe comprising the high-strength steel plate according to claim 3.

10. A high-strength steel pipe comprising the high-strength steel plate according to claim 6.

11. The high-strength steel plate according to claime 2, wherein the impact energy by the Charpy V notch test at −30° C. is greater than 234 J,and wherein the cementite present in one of nainite, martensite, or bainite and martensite has an average grain size of 0.2 μm or less.

* * * * *